US008635979B2

(12) United States Patent
Himsel et al.

(10) Patent No.: US 8,635,979 B2
(45) Date of Patent: Jan. 28, 2014

(54) DRAG LEVER

(75) Inventors: Frank Himsel, Obermichelbach (DE); Jochen Ott, Roettenbach (DE); Dirk Richter, Herzogenaurach (DE); Junichi Ichikawa, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 194 days.

(21) Appl. No.: 13/195,933

(22) Filed: Aug. 2, 2011

(65) Prior Publication Data

US 2012/0024248 A1 Feb. 2, 2012

(30) Foreign Application Priority Data

Aug. 2, 2010 (DE) ..... 10 2010 033 090

(51) Int. Cl.
*F01L 1/18* (2006.01)

(52) U.S. Cl.
USPC ..... 123/90.39; 123/90.44; 29/888.2; 74/559

(58) Field of Classification Search
USPC ..... 123/90.39, 90.44; 29/888.2; 74/559
See application file for complete search history.

(56) References Cited

U.S. PATENT DOCUMENTS 5,535,641 A 7/1996 Uchida et al.
6,199,527 B1 * 3/2001 Okubo et al. ..... 123/90.41

FOREIGN PATENT DOCUMENTS

DE 19810462 A1 9/1999
EP 1157193 A1 11/2001

* cited by examiner

*Primary Examiner* — Ching Chang
(74) *Attorney, Agent, or Firm* — Lucas & Mercanti, LLP

(57) ABSTRACT

A drag lever for actuating a gas exchange valve of an internal combustion engine. The drag lever includes an oblong lever body formed of sheet metal material, wherein the lever body has a bottom and side walls integrally formed at an angle of about 90° onto the bottom on both sides. A first end section of the lever body includes a joint socket formed into the bottom between the side walls. The joint socket serves to pivotally moveably support the drag lever on a joint head mounted stationary in the internal combustion engine. A middle section of the lever body is provided with a cam gripping surface, and a second end section of the lever body has a contact surface extending on the bottom. The contact surface serves for actuating the gas exchange valve. The lever body is dimensioned so as to have essentially the same width in a cross section through the joint socket and in a cross section through the middle section. Starting from the first end section of the lever body, the angle of the side walls increases continually to about 90°.

3 Claims, 2 Drawing Sheets

DRAG LEVER

This application is claims the priority of DE 10 2010 033 090.6 filed Aug. 2, 2010, which is incorporated by reference herein.

BACKGROUND OF THE INVENTION

The invention relates to a drag lever for actuating a gas exchange valve of an internal combustion engine. The drag lever has an oblong lever body formed of sheet metal material, wherein the lever body has a bottom and side walls integrally formed onto the bottom on both sides at an angle of about 90°. A first end section of the lever body includes a joint socket that is formed into the bottom between the side walls. The joint socket serves for the pivotally moveable support of the drag lever on a joint head which is mounted stationary in the internal combustion engine. A middle section of the lever body is provided with a cam gripping surface, and a second end section of the lever body has a contact surface extending on the bottom, wherein the contact surface serves for actuating the gas exchange valve. The lever body is dimensioned so as to have essentially the same width in a cross section through the joint socket and in a cross section through the middle section.

In the area of the first end section, the width of such a drag lever is determined by the size of the joint socket and the wall thickness thereof, and the wall thickness of the side walls extending at a more or less large distance from the joint socket. The size of the joint socket, in turn, results from the diameter of the usually spherical joint head of a support element and in the following is described as the nominal diameter of the joint socket.

Drag levers of this type are known, for example, from U.S. Pat. No. 5,535,641 and EP 1 157 193 B1. In comparison to the drag lever disclosed in DE 198 10 462 A1, whose lever body has a significantly greater width in the area of the joint socket, the drag lever disclosed in U.S. Pat. No. 5,535,641 already has a significantly smaller width by locally reducing the wall thickness of the side walls in the area of the joint socket extending therebetween.

In relation to the nominal diameter of the joint socket, the drag lever disclosed in EP 1 157 193 B1, has an extremely narrow structural width. This is apparent from FIGS. 3, 4, and 7 of this document in which the joint socket and side walls appear as if they are merging into each other. However, this document does not provide any concrete statements concerning a deformation process which would facilitate such a configuration of the lever body in the area of the joint socket.

Tests performed by the applicant of drag levers having a narrow structural width with side walls spaced closely from the joint socket have shown that the locally high degree of deformation at the connecting points of the bottom part and the side walls may lead to reduced material thicknesses of the joint socket which may at times in turn lead to cracks and squeeze folds. These structural faults, which, as a rule, are not apparent during the manufacture of the lever body and can only be detected safely with complicated destructive quality controls, can significantly impair the fatigue strength of the drag lever. As is well known, in the worst case, a premature failure of the drag lever due to breakage may lead to a complete destruction of the internal combustion engine. The lever widths B which can be practically achieved with the deformation processes of the lever body used today are at/east:

$$B=D+1.2*2S$$

D=nominal diameter of the joint socket

S=wall thickness of the lever body

The factor 1.2 is obtained from the distance between the joint socket and a side wall required for a crack-free deformation.

SUMMARY OF THE INVENTION

The present invention provides a drag lever in which, in relation to the nominal diameter of the joint socket, the joint socket is constructed as narrow as possible. Simultaneously, it is to be possible to deform the lever body by means of a reliable process, i.e. free of material faults, and with the necessary accuracy to shape substantially at the same cost.

Pursuant to the invention, the angle of the side walls, starting from the first end section of the lever body, should continuously increase to about 90°. In other words, it is provided that the side walls are not uniformly angled from the bottom over the entire length thereof, but essentially the side walls are twisted, wherein the angle of the side walls is small in the area of the joint socket and is preferably 0° at that location. In this manner, the degree of deformation of the lever body in the area of the joint socket and, consequently, the above-mentioned risk of material faults is significantly reduced in favor of the necessary fatigue strength of the drag lever.

In another embodiment, the joint socket rises between the side walls. In this configuration, the lever body forms, together with the bottom and the side walls, a cross sectional profile which is open in the direction remote from the gas exchange valve and is essentially U-shaped in the area of the 90° side wall angle. However, in comparison to the cited prior art, it must be noted that in the area of the joint socket small or entirely absent angles of the side walls result in a reduced axial moment of resistance, i.e. loss of stiffness of the lever body about its pivot axis. If necessary, this can be compensated in that on the side of the cam gripping surface the bottom contacts the joint socket with a cross section which is arched in the direction in which the joint socket rises. Such a configuration makes it possible with unchanged mobility of the lever body, which is pivoting back and forth relative to the support element, to increase the sectional height of the side walls (as compared to conventionally deformed lever bodies), and, thus, to minimize the reduction of the axial moment of resistance due to the profile.

In accordance with an alternative further embodiment, it may also be provided that the drag lever has, in conjunction with the twisted side walls, a so-called inverse U-shaped cross sectional profile which is open toward the gas exchange valve and in which the joint socket does not rise between the side walls, but in the opposite direction.

Additional features of the invention result from the following description and from the drawings in which a drag lever according to the invention is illustrated.

DETAILED DESCRIPTION OF THE INVENTION

Figure 5:
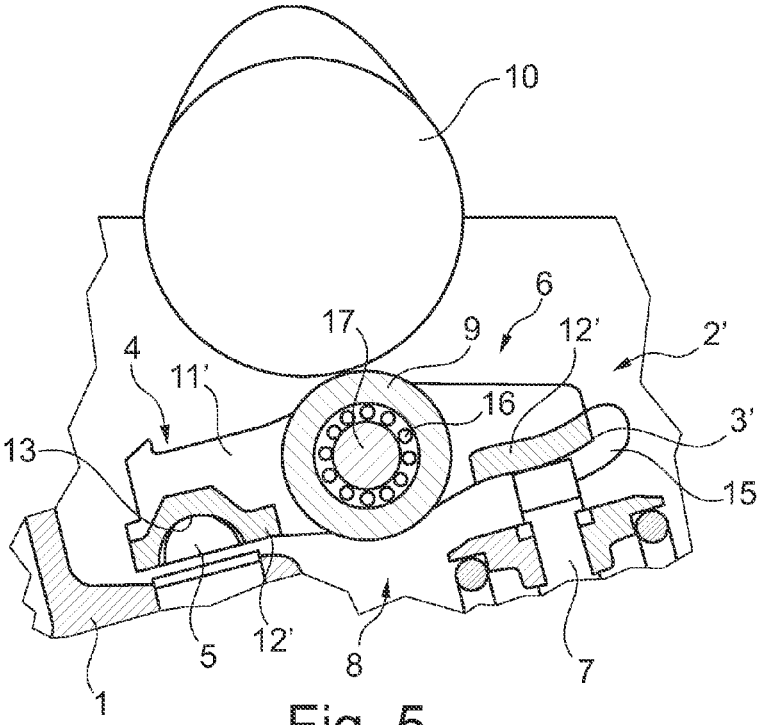
FIG. 5 shows a portion of a conventional drag lever valve drive.

The starting point of the description is the detail of a known drag lever valve drive of an internal combustion engine 1 illustrated in FIG. 5. The drag lever 2' illustrated in a longitudinal sectional view includes an oblong lever body 3' which rests so as to be pivotally moveable at its first end section 4 on a joint head 5 of a support element mounted stationary in the internal combustion engine 1 and, with its second end section 6 actuates the gas exchange valve 7 which is spring-biased in the closing direction. The middle section 8 of the lever body 3' is provided with a cam gripping surface 9 in the form of a roller which detects the raised portions of the cams of the cam shaft 10.

The lever body 3' which is cold-formed from sheet metal material is composed of two spaced apart side walls 11' and a bottom 12' connecting the side walls 11', wherein the bottom 12' is interrupted in the area of the roller 9. The bottom 12' and the two side walls 11' formed at an angle of 90° at the bottom 12' form an essentially U-shaped cross sectional profile which is open toward the direction remote from the gas exchange valve. A dome-shaped joint socket 13 is formed into the part of the bottom 12' extending at the first end section 4 of the lever body 3' which joint socket 13 rises between the side walls 11' and, together with the joint head 5 of the support element, forms a spherical joint head. Formed onto the part of the bottom 12' extending on the second end section 6 of the lever body 3' are a contact surface 14 for the shaft end of the gas exchange valve 7 and valve guide webs 15 extending on both sides of the contact surface 14. The roller 9 is supported by means of a needle bearing 16 on an axial bolt 17 spanning the side walls 11'.

The lever body 3 of the drag lever 2 according to the invention illustrated in FIGS. 1 to 4 differs from the known drag lever 2' by way of the configuration of the side walls 11. The side walls are not continuously angled by 90° relative to the bottom 12, but are shaped so as to be twisted in the longitudinal direction of the lever body 3. In the area of the first end section 4, i.e., in the area of the joint socket 13, the side wall angle is 0°. Starting therefrom, the side wall angle continually increases and reaches 90° in the middle section 8 of the lever body 3, i.e., in the axial contact area for the end faces 18 of the roller 9. This angle remains constant up to the second end section 6 of the lever body 3. The twisting of the side walls 11 can be recognized in the FIGS. 1 to 3, and particularly in FIG. 4, by the fact that the upper edges 19 of the side walls 11 are oriented in the area of the joint socket 13 perpendicularly to the bottom 12, while in the middle section 8 and at the second end section 6 of the lever body 3 the upper edges 19 are oriented parallel to the bottom 12.

Figure 3:
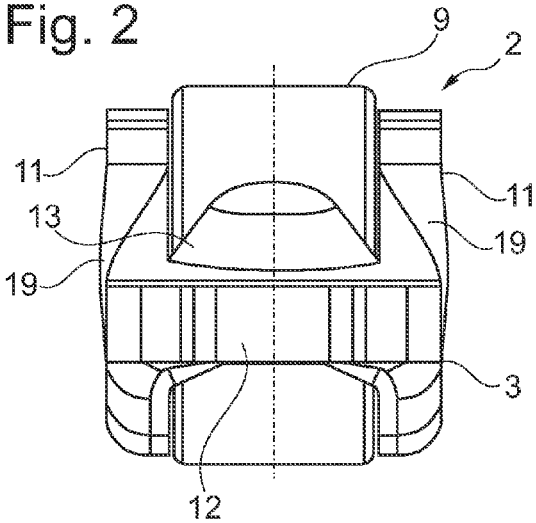
FIG. 3 shows the drag lever in a front view of the joint socket.
Figure 4:
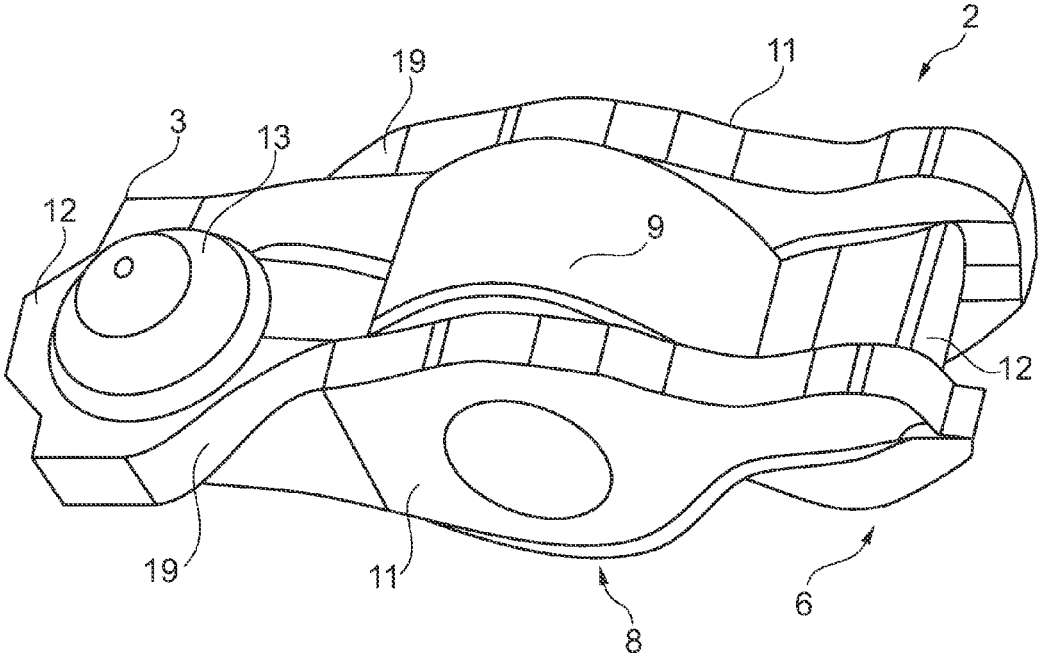
FIG. 4 shows the drag lever in a perspective view.

As can be seen particularly from FIG. 3, the side walls 11 are aligned with each other because of their 0° angle with the part of the bottom 12 into which the joint socket 13 is formed. This configuration in the area of the joint socket 13 which is advantageous with respect to deformation technology makes it possible that the lever body 3, in a cross section through the joint socket 13 and in a cross section through the middle section 8, has essentially the same width, or, expressed more precisely, is dimensioned equally narrow.

Figure 1:
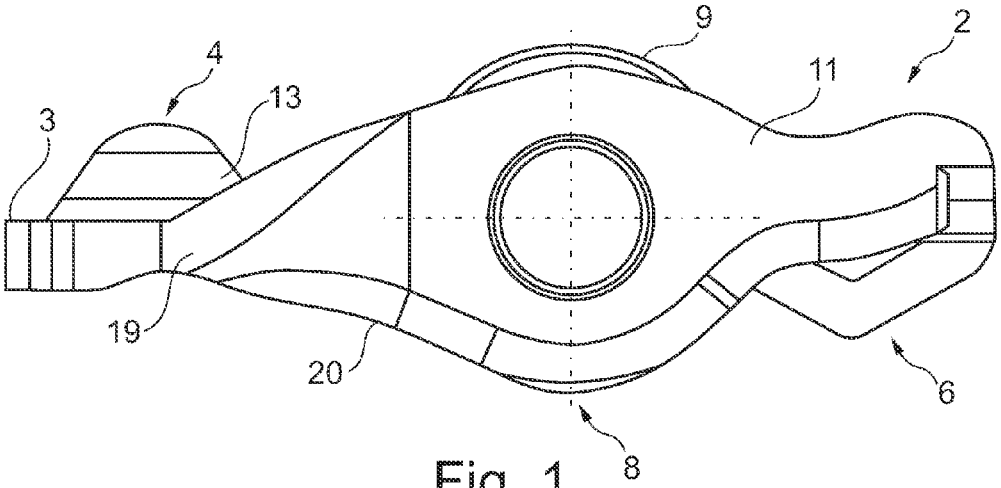
FIG. 1 is a side view of the drag lever.
Figure 2:
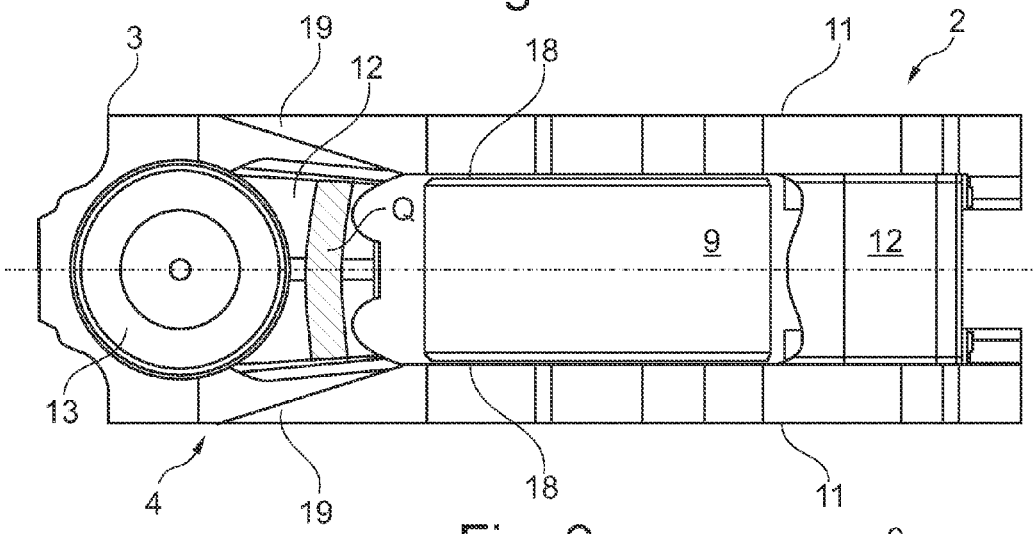
FIG. 2 is a top view of the drag lever.

In accordance with the cross section Q shown in FIG. 2, the part of the bottom 12 which extends on the first end section 4 of the lever body 3 on the side of the roller 9 is arched in the direction in which the joint socket 13 rises. The curvature of the bottom adjoins the opening of the joint socket 13, so that, in the case of pivoting movements of the drag lever 2, a sufficient freedom of movement of the bottom 12 relative to the support element (see FIG. 5) is ensured. Compared to a bottom which is not curved at this location, the curvature of the bottom has the effect that the bottom edges 20 of the side walls 11 (see FIG. 1) are located deeper in the direction of the gas exchange valve 7 (see FIG. 5). With the correspondingly increased height of the side walls 11, the axial moment of resistance of the lever body 3, and, consequently, the stiffness of the drag lever 2 in the pivoting direction thereof, increases. In this manner, the loss of the stiffness of the drag lever 2 caused by arranging the side walls 11 at an angle in accordance with the invention, is compensated.

LIST OF REFERENCE NUMERALS

1. Internal combustion engine
2. Drag lever
3. Lever body
4. First end section of the lever body
5. Joint head
6. Second end section of the lever body
7. Gas exchange valve
8. Middle section of the lever body
9. Roller/cam gripping surface
10. Cam shaft
11. Side wall
12. Bottom part
13. Joint socket
14. Contact surface
15. Valve guiding web
16. Needle bearing
17. Axial bolt
18. End face of roller
19. Upper edge of side wall
20. Lower edge of side wall

The invention claimed is:

1. A drag lever for actuating a gas exchange valve of an internal combustion engine, the drag lever comprising an oblong lever body formed of sheet metal material, the lever body having a bottom and side walls integrally formed at an angle onto the bottom on both sides, the bottom extending in a lateral direction between the sidewalls, wherein the lever body has a first end section with a joint socket formed into the bottom between the side walls, wherein the joint socket serves to pivotally moveable support the drag lever on a joint head mounted stationary in the internal combustion engine, the lever body having a middle section with a cam gripping surface, and a second end section with a contact surface extending on the bottom so that the contact surface serves for actuating the gas exchange valve, the lever body being dimensioned so as to have substantially a common width in a cross section through the joint socket and in a cross section through the middle section, wherein the sidewalls are twisted in a transition area between the middle section and the first end section such that an angle of the sidewalk relative to the lateral direction is 90° at the middle section and the angle of the side walls relative to the lateral direction decreases continually from the middle section toward the first end section of the lever body.

2. The drag lever according to claim 1, wherein the angle of the side walls is 0° at the first end section.

3. The drag lever according to claim 1, wherein the joint socket rises between the side walls, and wherein the bottom is located on a side of the cam gripping surface adjacent the joint socket and has a cross section which is arched in a rising direction of the joint socket.

* * * * *